United States Patent [19]

Westerlund

[11] 4,052,287

[45] Oct. 4, 1977

[54] ELECTROLYTIC SYSTEM AND NOVEL ELECTROLYTIC CELLS AND REACTOR THEREFOR

[75] Inventor: G. Oscar Westerlund, Vancouver, Canada

[73] Assignee: Gow Enterprises Limited, Vancouver, Canada

[21] Appl. No.: 693,888

[22] Filed: June 8, 1976

[30] Foreign Application Priority Data

Apr. 1, 1976 Canada ..... 249382

[51] Int. Cl.[2] ..... C25B 15/08; C25B 9/00

[52] U.S. Cl. ..... 204/237; 204/239; 204/268; 204/269; 204/270

[58] Field of Search ..... 204/237, 238, 239, 268–270

[56] References Cited

U.S. PATENT DOCUMENTS

| | | | |
|---|---|---|---|
| 3,779,889 | 12/1973 | Loftfield | 204/268 |
| 3,928,165 | 12/1975 | Piester | 204/278 |
| 3,930,980 | 1/1976 | DeNora et al. | 204/268 X |
| 3,948,748 | 4/1976 | Messner et al. | 204/268 X |

*Primary Examiner*—John H. Mack
*Assistant Examiner*—D. R. Valentine
*Attorney, Agent, or Firm*—Millen & White

[57] ABSTRACT

A novel electrolytic system, especially suitable for chlorate manufacture, is provided constituted by a novel electrolyzer and a novel reactor. The novel separate electrolyzer is designed for multicell assembly employing sheet metal electrodes and includes novel internal construction specially designed to hold the electrodes in place and to minimize internal liquor overflow between adjacent cells. The novel reactor provides suitable electrolyte retention time, temperature and product composition control respectively as well as gas separation with liquor level controlled for flooded electrolyzer system. The electrolyzer and the reactor are connected by liquor interconnection means.

32 Claims, 11 Drawing Figures

ELECTROLYTIC SYSTEM AND NOVEL ELECTROLYTIC CELLS AND REACTOR THEREFOR

BACKGROUND OF THE INVENTION

1. Field of the Invention

This invention relates to an electrolysis system including an electrolyzer containing a plurality of bipolar electrolytic cells particularly suitable for the production of metal chlorates, particularly alkali metal chlorates. It relates, more specifically, to an electrolysis system including an improved electrolytic cell and apparatus containing multiple unit cells. The present invention also relates to an improved reactor for use in an electrolysis system.

2. Description of the Prior Art

Known electrolytic cells for the production of metal chlorate have certain disadvantages. Monopolar cells inherently have many power connections and electrolyte branches, gas phase above electrolyte level with electrode connectors extending through the gaseous zone with resulting danger of gas explosions and fires as well as high voltage drop; furthermore, many units are required in commercial production and large building space is occupied. Bipolar cells are designed for more compactness, but have other disadvantages and problems such as, for example, current leakage, channelling of electrolyte and gaseous products, as well as construction and assembly difficulties. Generally both types of cells employed graphite anodes until recent years when many of the commercial plants changed from graphite to dimensionally stable anodes of noble metal-coated titanium material. Almost all of the new installations favour the new anodes.

The benefits of metal electrodes in the manufacture of products, for example, chlorine-alkali, chlorate, perchlorates, etc., have been indicated in many publications; e.g. Canadian Patent No. 771,140 issued Nov. 7, 1967 to S.I. Burghardt relates to the advantages of metal electrodes; another Canadian Patent No. 631,022 issued Nov. 14, 1961 to R. G. Cottam and M. G. Derlez relates to anode improvements of said type.

One problem in employing metal electrodes in both monopolar and bipolar electrolytic cells is primarily that, because of the cost of the electrodes, electrode thicknesses are normally minimized. Also, in order to minimize power consumption, the cell gap is frequently quite small; e.g., a metal electrode suitable for chloride electrolysis may be relatively thin sheeting of titanium, for example, 0.5 to 3 mm, which is surface coated on each face to provide that best anode and in some cases cathode surfaces respectively. This coating may be from only a few to a few hundred microns in thickness. The optimum electrolytic cell gap for electrodes of this type and for the manufacture of, e.g., chlorate, will depend upon many factors, such as, for example, the surface coating of electrodes, the current density, the electrode height, the gas-to-liquor ratio, the electrolyte composition and the temperature. For conventional cell conditions in which, for example, the electrode height is 200 to 1500 mm, the current densities are from 1 to 4 KA per square meter and the gas/liquor ratio is approximately 1:1, and the optimum cell gap is probably between 1 and 10 mm.

Although certain inherent advantages accrue in the use of metal electrodes instead of graphite electrodes, monopolar and bipolar electrolytic cells are not generally designed for use with metal electrodes. Advantages of the use of metal electrodes including the following:

i. compact cells, because of the use of thin electrodes and a high current density;
ii. lower power consumption, because of better surface properties, i.e., lower over-voltages, lower resistance in electrode material as well as in the electrolyte due to higher operating temperatures, and smaller average electrode gaps resulting in less voltage drop;
iii. high operating temperature, thereby minimizing the requirement for heat exchangers in the system to provide temperature control;
iv. provide for vaporization of water, in order to increase electrolyte and product strength;
v. clean electrolyte, since metal electrodes do not normally show any significant mechanical erosion and subsequent charging of matter which is suspended in the electrolyte; and
vi. less foam problems of the electrolyte, since the metal electrodes do not normally add ingredients to the electrolyte which would result in a foam problem which may be the case when employing, e.g., impregnated graphite electrodes.

The art of electrolytical manufacture of chlorates has developed significantly in recent years mainly because of the established excellent performance of the titanium surface-coated anodes referred to above. The electrolytic systems utilizing these anodes, however, generally are mere modifications of conventional apparatus and in most cases, comprise monopolar cell units suspending the anodes from the cell tank cover between steel cathode sheets welded to the cell tank. Thus, in recent years, there have been new developments both in the design of electrolytic cells and in the design of the electrodes disposed therein. Both monopolar and bipolar electrode types of system have been developed, some of which are used in commercial production One of those systems is described in Canadian Patent No. 914,610 issued Nov. 14, 1972 to G. O. Westerlund, in the following terms: A novel electrolysis apparatus includes at least two modular monopolar electrolytic cells. Each such modular monopolar electrolytic cell includes an open-ended main chamber having inlet means for the flow of electrolyte to, and between, adjacent, parallel, alternately spaced anodes and cathodes, and outlet means constructed and arranged to withdraw electrolyte along with gaseous products of electrolysis entrained and/or occluded therein from the chamber, the main chamber being electrically isolated from the anodes and cathodes. An anode end plate is disposed at, and seals, one open end thereof, the anode end plate being provided with a plurality of spaced-apart anodes projecting from one face thereof into the main chamber. A cathode end plate is disposed at, and seals, the other open end, the cathode end plate being provided with a plurality of spaced-apart cathodes projecting from one face thereof into the main chamber in staggered alternate relationship to the anode also projecting into the main chamber. A common intermediate cathode-anode holding and current transmitting plate is disposed at, and seals, the adjacent open ends of two adjacent such cells. It is provided with a plurality of spaced-apart cathodes projecting from one face thereof into the main chamber in staggered alternate relationship to the anodes also projecting into the main chamber, and a plurality of spaced-apart anodes projecting from the other face thereof into the main chamber in staggered alternate relationship to the cathodes also projecting into the main chamber. The anodes and cathodes occupy less than the entire cross-sectional area of the main chamber, thereby to provide at least one non-electrolysis zone within each such cell. This enables internal liquor circulation resulting from gases evolved on the electrode surfaces to interchange electrolyte between the electrodes and to provide substantially homogeneous conditions in the cell chamber.

Although this design has a proven efficient performance, the construction is not one which can readily be carried out in the field. This is because the modular cell assembly comprises a plurality of electrode plates which must be carefully fitted when assembling the multiunit cell in order to avoid electrical short circuiting between adjacent cell modules. Cells designed for operation under low voltage conditions by having close spacing between electrodes are thus not readily maintained or constructed in the field. This disadvantage also applies to most other high efficiency electrolytic cells.

The above-identified Canadian Patent No. 914,610 also provides novel metal electrode contructions for electrolytic cells. The combined electrolyzer reactor employs an electrode arrangement where all anodes are welded to one side of a first carrier plate. A second carrier plate has matching cathode steel plates. In the electrolyzer the cathodes of the second carrier plate are fitted between the anodes of the first carrier plate. This requires hours of fitting for each cell in order to avoid the presence of any electrical short circuits. Capital cost would be high due to the tight tolerance limits required for satisfactory operating.

Recently significant progress was made in advancing the technology by the feature of module electrodes (H. B. Westerlund, U.S. Patent Appln. Ser. No. 618,078 filed September 30, 1975, now U.S. Pat. 3,994,798. Such modules may be described as comprising a plurality of modular bipolar electrode assemblies, each comprising: (1) a plate-like metallic anode formed of anode material; (2) a plate-like metallic cathode formed of cathode material; (3) a generally V-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode; and (4) a plurality of electrically insulating spacer elements projecting outwardly from both side faces of at least the plate-like metallic cathode; and further including at least two median electrodes each interposed between, and connected to, a plate-like metallic anode and a plate-like metallic cathode, with the anodes and cathodes interleaved and spaced apart by the electrically non-conducting spacers, and with adjacent V-shaped median electrode plates in electrical connection with each other and adapted to provide current flow transversely of the assembly, which are disposed in a framework including a plurality of transversely extending titanium support plates within which the upwardly extending slot is accommodated, thereby to cooperate with the electrically connected median electrodes and adapted to provide current flow transversely of the assemblies.

Specifically referred to the chlorate manufacture, it is well known that alkali metal chlorates may be prepared by electrolysis of an aqueous solution of an alkali metal chloride. This process has been fully described in Canadian Patent No. 741,778 issued Aug. 30, 1966 to G. O. Westerlund.

This simplified reaction in the aforesaid electrolysis may be summarized as:

$$MtCl + 3H_2O + 6\ \text{Faradays} — MtClO_3 + 3H_2$$

(wherein Mt is a metal)

The main reactions in the electrolytic preparation of the metal chlorate from the metal chloride may be represented as follows:

Primary Reactions

A. at the anode:

$$2MtCl — 2Mt^+ + 2Cl^- — Cl_2 + 2e^- + 2Mt^+ \quad (1)$$

B. at the cathode:

$$2H_2O — 2H^+ + 2OH^- + 2e^- — H_2 + 2OH^- \quad (2)$$

Secondary Reactions

C.

$$Cl_2 + OH^- — ClOH + Cl^- \quad (3)$$

$$ClOH — H^+ + OCl^- \quad (4)$$

D.

$$2ClOH + ClO^- — ClO_3 + 2Cl^- + 2H^+ \quad (5)$$

The primary reactions take place in the electrolyzer. The secondary reactions yield products in the electrolyzer but for high efficiency a reacting zone is necessary with interflow of active electrolyte for control of pH and to promote chlorate producing reaction (5) by the retention time which is provided by reacting volume. The art of producing chlorate at high efficiency is, as is well known, dependent upon the design of the system to facilitate proper channelling of electrolyte as well as reacting time.

SUMMARY OF THE INVENTION i. Aims of the Invention

The improvement provided by the present invention in its varous aspects may be used for a number of electrochemical procedures and with variation in structures; it is especially suited for use of the electrode modules as per the art described above and for electrolytic manufacture of chlorates and perchlorates.

It is an object of this invention to provide a combined electrolytic system including a novel electrolyzer and novel reactor combination which is easy to assemble.

It is another object of this invention to provide a novel internal construction for an electrolyzer.

It is yet another object of this invention to provide a novel electrolyzer in which internal liquor overflow between adjacent cells is minimized.

Still another object of this invention is to provide a reactor which provides suitable electrolyte retention time, temperature and product composition control.

A still further object of this invention is to provide a reactor operable under flooded conditions and including gas separator means.

ii. Statements of Invention

The novel system of this invention includes an electrolyzer and a reactor. These two component vessels communicate by pipe connections for channelling the total active electrolyte and generated gaseous product from the electrolyzer to the reactor. The driving force for flow is uplift of the gaseous products generated on the surface of the electrodes in the electrolyzer. These gases are discharged from the header of the reactor. The degasified liquor, after appropriate retention time by volume design, adjustment in chemical composition and cooling for temperature control, is channelled back to the elctrolyzer for regeneration of new products.

Thus, this invention provides a closed loop system for effecting an electrolysis reaction and for subsequently removing reacted products of electrolysis. The system includes: (1) an electrolyzer including a plurality of interconnected electolytic cells, the electrolyzer being provided with liquor inlet means to, and liquor outlet means from, a selected one of the interconnected electrolytic cells, for removal of liquor and entrained and/or entrapped gaseous products of electrolysis, the electrolyzer being operated under conditions whereby it is substantially full of liquor. It also includes (2) reactor means including degasifier means disposed atop the reactor means, and connected directly to the outlet means and constructed and arranged to remove at least 99% of the entrained and/or entrapped gaseous products of electrolysis from the degasifier means including an upper liquor-free zone having outlet means for the separated gases, and a lower outlet slot directly connected to an upper zone of the reactor means, for the introduction of the substantially gas-free liquor into the reactor means, the reactor means being so constructed and arranged as to be substantially full of the substantially gas-free liquor during the course of the reaction of the liquid primary products of electrolysis and to provide sufficient retention time to effect such reaction, the reactor means including a lower liquor channelling means, connected to liquor outflow channel means to recirculate liquor back to the electrolyzer, fresh liquor entry means, pH adjustment means, and indirect cooling means. The liquor outflow means is connected to the same electrolytic cell selected for the liquor outlet means.

This invention also provides a combined electrolytic apparatus. It includes (1) an enclosed electrolyzer comprising (A) inlet means for electrolyte thereto and outlet means for products of electrolysis therefrom; (B) a plurality of interconnected electrolytic cells provided with bipolar metal electrodes disposed in the path of the electrolyte flow between the inlet means and the outlet means, one end wall providing an anodic end sheeting, the other end providing a cathodic end sheeting, with an anode bus bar connected to the anodic end sheeting, and a cathodic bus bar connected to the cathodic end sheeting, wherein the inlet means to, and the outlet means from, the electrolyzer are from the same electrolytic cell; (C) a downwardly sloping front wall; and (D) a wedge disposed between the electrodes and the front wall, thereby to hold the electrodes in place, and to minimize internal liquor overflow between adjacent cells. The apparatus also includes (2) a reactor including (E) degasifier means disposed atop the reactor means, and connected directly to the outlet means and constructed and arranged to remove at least 99% of the entrained and/or entrapped gaseous products of electrolysis from the liquid primary products of electrolysis, the degasifier means including an upper liquor-free zone having outlet means for the separated gases, and a lower outlet slot directly connected to an upper zone of the reactor means, for the introduction of the substantially gas-free liquor into the reactor means, the reactor means being so constructed and arranged as to be substantially full of the substantially gas-free liquid primary products of electrolysis and to provide sufficient retention time to effect such reaction; (F) a lower liquor channelling means, connected to liquor outflow channel means to recirculate liquor back to the electrolyzer, the liquor outflow means being connected to the same electrolytic cell selected for the outlet means; (G) fresh liquor entry means; (H) pH adjustment means; and (I) indirect cooling means.

This invention still further provides a novel electrolysis system. It includes (1) an enclosed electrolyzer comprising: (A) inlet means for electrolyte thereto and outlet means for products of electrolysis therefrom; (B) a plurality of interconnected electrolytic cells provided with bipolar metal electrodes disposed in the path of the electrolyte flow between the inlet means and the outlet means, one end wall providing an anoidic end sheeting, the other end wall providing a cathodic end sheeting, with an anode bus bar connected to the cathodic end sheeting, wherein the inlet means to, and the outlet means from, the electrolyzer are from the same electrolytic cell; (C) a downwardly sloping front wall; (D) a wedge disposed between the electrodes and the front wall, thereby to hold the electrodes in place, and to minimize internal liquor overflow between adjacent cells; (E) a lower liquor distributing trough connected to the electrolyzer inlet means and disposed below the bipolar electrodes; (F) a top liquor distributing channel disposed above the bipolar electrodes, and connected directly to the outlet means; and (G) circulation means provided by internal pumping action due to the construction and arrangement of the bipolar electrodes and the rising gaseous roducts of the electrolysis, with the outlet means from, and inlet means to, a reactor providing at least a partial separation of entrained gaseous products of electrolysis from the effluent liquor. The system also includes (2) a reactor for effecting a further degasification and a reaction on the liquid products of electrolysis, the reactor including: (H) degasifier means disposed atop the reactor means, and connected directly to the outlet means and constructed and arranged to remove at leat 99% of the entrained and/or entrapped gaseous products of electrolysis from the liquid primary products of electrolysis from the liquid primary products of electrolysis, the degasifier means including an upper liquor-free zone having outlet means for the separated gases, and a lower outlet slot directly connected to an upper zone of the reactor means, for the introduction of the substantially gas-free liquor into the reactor means, the reactor means being so constructed and arranged as to be substantially full of the substantially gas-free liquor during the course of the reaction of the liquid primary products of electrolysis and to provide sufficient retention time to effect such reaction; (I) a lower liquor channelling means, connected to liquor outflow channel means to recirculate liquor back to the electrolyzer, wherein the liquor outflow means is connected to the same electrolytic cell selected for the outlet means; (J) means for recycling a determined proportion of the liquid reaction products to the enclosed electrolyzer; (K) means for regulating the temperature of the products recycled to the electrolytic cell including a plurality of water heat exchanger coils projecting downwardly centrally within the reactor; and (L) means for withdrawing a determined proportion of the effluent from the system, including a depending effluent pipe whose inlet is disposed near the bottom of the reactor and whose outlet withdraws liquor through a top nozzle.

This invention provides still further, an enclosed electrolyzer comprising: (A) inlet mens for electrolyte thereto, and outlet means for products of electrolysis therefrom; (B) a plurality of interconnected electrolytic cells provided with bipolar metal electrodes disposed in the path of the electrolyte flow between the inlet means and the outlet means, one end wall providing an anodic end sheeting, the other end wall providing a cathodic end sheeting, with an anode bus bar connected to the anodic end sheeting, and a cathodic bus bar connected to the cathodic end sheeting, wherein the inlet means to, and the outlet means from, the electrolyzer are from the same electrolytic cell; (C) a downwardly sloping front wall; and (D) a wedge disposed between the electrodes and the front wall, thereby to hold the electrodes in place, and to minimize internal liquor overflow between adjacent cells.

This invention also provides an enclosed electrolyzer comprising: (A) inlet means for electrolyte thereto and outlet means for products of electrolysis therefrom; (B) a plurality of interconnected electrolytic cells provided with bipolar metal electrodes disposed in the path of the electrolyte flow between the inlet means, one end wall providing an anodic end sheeting, the other end wall providing a cathodic end sheeting, with an anode bus bar connected to the anodic end sheeting, and a cathodic bus bar connected to the cathodic end sheeting, wherein the inlet means to, and the outlet means from, the electrolyzer are from the same electrolytic cell; (C) a downwardly sloping front wall; (D) a wedge disposed between the electrodes and the front wall, thereby to hold the electrodes in place, and to minimize internal liquor overflow between adjacent cells; (E) a lower liquor distributing trough connected to the electrolyzer inlet means and disposed below the bipolar electrodes; (F) a top liquor distributing channel disposed above the bipolar electrodes, and connected directly to an electrolyzer cover leading directly to the outlet means; and (G) circulation means provided by internal pumping action due to the construction and arrangement of the bipolar electrodes and the rising gaseous products of the electrolysis.

iii. Other features of the Invention

The electrolyzer comprises in one further feature a longitudinally extending vessel, the reactor comprises a longitudinally extending vessel, and the electrolyzer and the reactor are disposed side-by-side, with the product liquor outlet means extending transversely from the electrolyzer and the liquor outflow means extending tranversely from the reactor.

The electrolyzer cover, in another feature, comprises a semi-cylindrical member whose radius is non-uniform from one end to the other, either where the radius is greater at the center than at each of the ends of the cover, or where the radius is greater at one end than at the other end of the cover.

The outflow pipe, in another feature, leads directly from the cover, from a point adjacent the greater radius end thereof, or the outflow pipe leads directly from the cover, from the point between the ends thereof, of the greatest radius.

The anode bus bar and the cathode bus bar are preferably disposed between the electrolyzer and the reactor.

The vessel in another feature is taller than the electrode height to provide a trough at the bottom and a channel at the top, the trough being defined by the bottom of the electrolyzer and a titanium plate upon which the electrodes rest, the bottom trough providing a distributor for the recirculation of return flow liquor fed from the return flow pipe, and the channel at the top providing a header for the withdrawal of products of electrolysis to the product overflow pipe.

The cross-sectional area of the trough is preferably made larger towards the direction of the electrolytic cell directly connected to the product liquor outflow pipe.

The cross-sectional area of the top channel is generally made larger towards the direction of the electrolytic cell directly connected to the product liquor outflow pipe. Also, the cross-sectional area of the trough is generally made larger towards the direction of the electrolytic cell directly connected to the product liquor outflow pipe and further the cross-sectional area of the top channel is made larger towards the direction of the electrolytic cell directly connected to the product liquor outflow pipe.

The electrolyzer, in another feature, comprises a longitudinally extending rectangular parallelepiped vessel, the reactor comprises an upright right cylindrical vessel, the reactor is disposed at the downstream end of the electrolyzer, the product liquor outlet means extends longitudinally from the electrolyzer to the side wall of the reactor, and the liquor outflow means extends from the side wall of the reactor and extends longitudinally to the electrolyzer.

The vessel is generally taller than the electrode height to provide a trough at the bottom and a channel at the top, the trough being defined by the bottom of the electrolyzer and a titanium plate upon which the electrodes rest, the bottom trough providing a distibutor for the recirculation of return flow liquor fed from the return flow pipe, the channel at the top provides a header for the withdrawal of products of electrolysis to the product outflow pipe and the bottom trough is fed from a liquor return header extending longitudinally along one side wall of the electrolyzer connected to a vertically extending outlet slot in the slide wall of the reactor.

The electrolyzer is also preferably provided with a sloping cover, and the cross-sectional area of the top channel is made larger towards the direction of the electrolytic cell directly connected to the product liquor outflow pipe.

The cross-sectional area of the trough is usually made larger towards the direction of the electrolytic cell directly connected to the product liquor outflow pipe, particularly where the cross-sectional area of the trough is made larger towards the direction of the electrolytic cell directly connected to the product liquor outflow pipe.

The electrolyzer, in still another feature, comprises a longitudinally extending rectangular parallelepiped vessel, the reactor comprises an upright right cylindrical vessel, the reactor is disposed at the downstream end of the electrolyzer, the product liquor outlet means extends longitudinally from the electrolyzer to the side wall of the reactor, the liquor outflow means extends from the side wall of the reactor and extends longitudinally to the electrolyzer, and the electrolyzer cover comprises a semi-cylindrical member whose radius is non-uniform from one end to the other, namely wherein the radius is greater at one end that at the other end of the cover.

The vessel is generally taller than the electrode height to provide a trough at the bottom and a channel at the top, the trough being defined by the bottom of the electrolyzer and a titanium plate upon which the electrodes rest, the bottom trough providing a distributor for the recirculation of return liquor fed from the return flow pipe, and the channel at the top providing a header for the withdrawal of products of electrolysis to the product outflow pipe.

The cross-sectional area of the trough is usually made larger towards the direction of the electrolytic cell directly connected to the product liquor outflow pipe.

The cross-sectional area of the top channel is generally made larger towards the direction of the electrolytic cell directly connected to the product liquor outflow pipe, especially where the cross-sectional area of the top channel is made larger towards the direction of the electrolytic cell directly connectd to the product liquor outflow pipe.

The cover, in another feature, comprises a semi-cylindrical member whose radius at one end is greater than at the other.

Either the outflow pipe, in one feature, leads directly from the cover, from a point adjacent one end thereof, or the outflow pipe leads directly from the cover, from a point between the ends thereof.

The product outflow pipe generally leads transversely towards the reactor, the return pipe leads transversely from the reactor, and the anode bus bar and the cathode bus bar are disposed between the electrolyzer and the reactor.

The electrolyzer vessel, in still another feature, is taller than the electrode height to provide a trough at the bottom and a channel at the top, the trough being defined by the bottom of the electrolyzer and a plate, preferably of titanium, upon which the electrodes rest, either where the cross-sectional area of area of the trough is made larger towards the direction of the electrolytic cell directly connected to the product liquor outflow pipe, or where the cross-sectional area of the top channel is made larger towards the direction of the electrolytic cell directly connected to the product liquor outflow pipe.

The electrodes of the electrolytic cell, in yet another feature, are of the module type comprising: (1) a plate-like metallic anode formed of anode material; (2) a plate-like metallic cathode formed of cathode material; (3) a generally V-shaped in cross-section median electrode plate formed of titanium or a titanium alloy, interposed between, and connected to, each of the plate-like metallic anode and the plate-like metallic cathode, the median electrode extending below the bottom edge of the plate-like metallic anode and the plate-like metallic cathode, and extending above the top edge of the plate-like metallic anode and the plate-like metallic cathode; and (4) a plurality of electrically insulating spacer elements projecting outwardly from both side faces of at least the plate-like metallic cathode.

The electrolyzer vessel, in a still further feature, is taller than the electrode height to provide a trough at the bottom and a channel at the top, the trough being defined by the bottom of the electrolyzer and a titanium plate upon which the electrodes rest, the front wall is downwardly sloped from top to bottom, and a wedge is provided between the electrodes and the sloping front wall.

The conduction plate is generally provided with plastic ledges for the lower end corner of the electrode to rest on.

The electrolyzer vessel, in yet another feature, is taller than the electrode height to provide a trough at the bottom and a channel at the top, the trough being defined by the bottom of the electrolyzer and a titanium plate upon which the electrodes rest, the bottom trough providing a distributor for the recirculation of return flow liquor fed from the return flow pipe, and the channel at the top providing a header for the withdrawal of products of electrolysis to the product outflow pipe.

The cross-sectional area of the trough is generally made larger towards the direction of the electrolytic cell directly connected to the product liquor outlfow pipe. The cross-sectional area of the top channel is usually made larger towards the direction of the electrolytic cell directly connected to the product liquor outflow pipe.

The bottom trough is generally fed from a liquor return header extending longitudinally along one side wall of the electrolyzer connected to a vertically extending outlet slot in the side wall of the reactor.

The electrolyzer is usually provided with a sloping cover wherein the cross-sectional area of the top channel is made larger towards the direction of the electrolytic cell directly connected to the product liquor outflow pipe.

The electrolyzer cover, in another feature, comprises a semi-cylindrical member whose radius is non-uniform from one end to the other, namely wherein the radius is greater at one end than at the other end of the cover.

BRIEF DESCRIPTION OF THE DRAWINGS

In the accompanying drawings.

DESCRIPTION OF PREFERRED EMBODIMENTS i. Description of FIGS. 1 - 4

Figure 1:
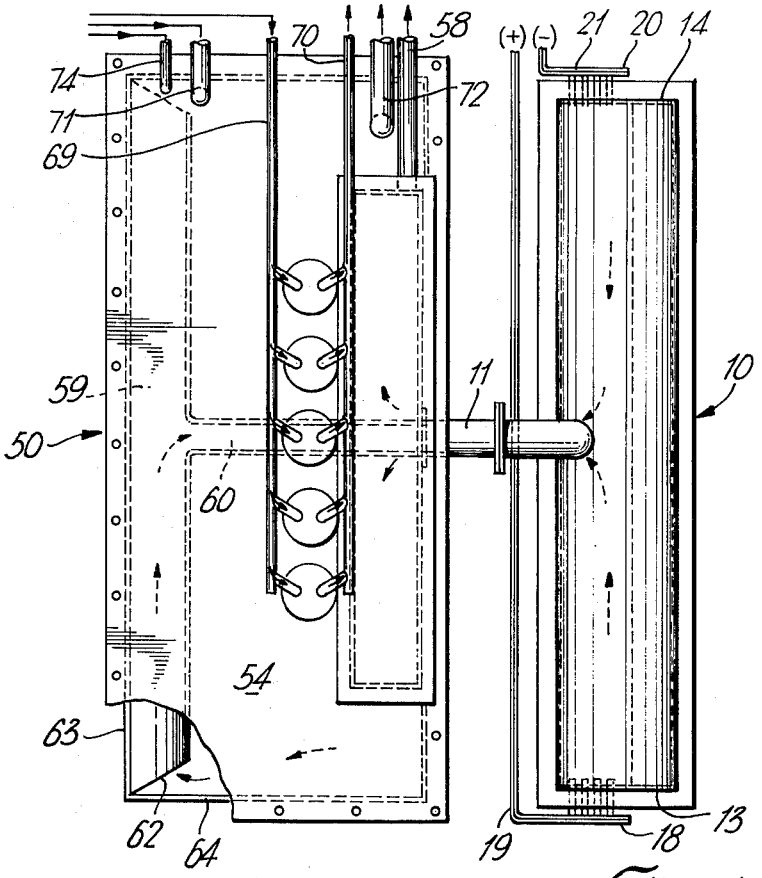
FIG. 1 is a top plan view, partially broken away, of an electrolytic system according to this invention.
Figure 2:
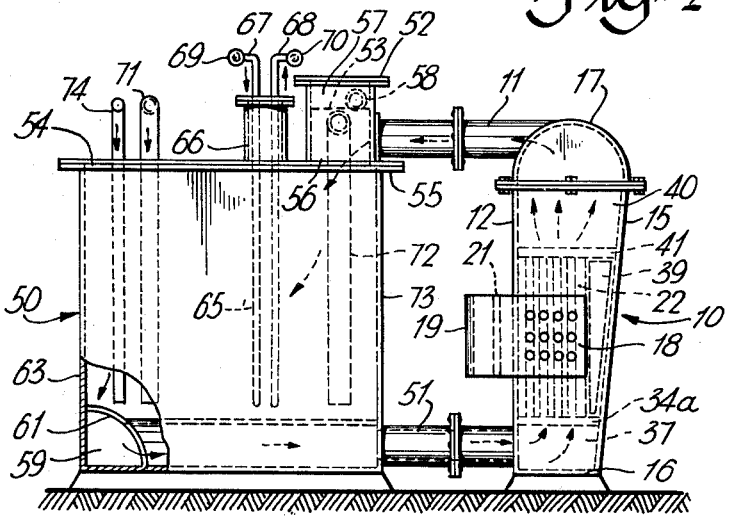
FIG. 2 is a side elevational view, partially broken away and in phantom, of the embodiment of FIG. 1.

As seen in FIGS. 1 and 2, the electrolytic system includes an electrolyzer 10 and a reactor 50 interconnected by an outflow pipe 11 and a return flow pipe 51.

The electrolyzer 10 is generally a rectangular parallelepiped but includes, in addition to a back wall 12 and end walls 13, 14, a downwardly sloping front wall 15. It is also provided with a flat bottom wall 16 and a generally hemicylindrical top cover 17. Anode end sheeting 18 is secured to end wall 13 and is connected to an anode source (not shown) by means of a longitudinal extending anode bus bar 19. Similarly, cathode end sheeting 20 is secured to end wall 14 and is connected to a cathode source (not shown) by a longitudinally extending cathode bus bar 21.

Figure 3:
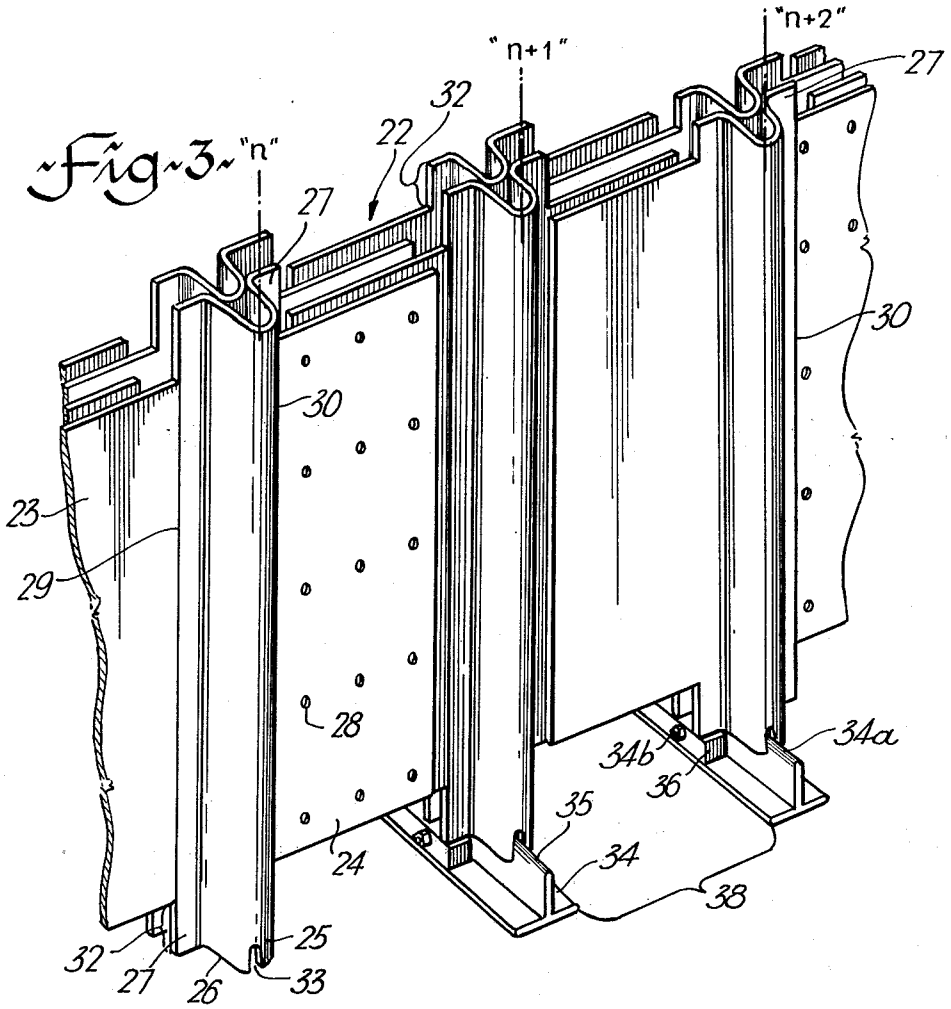
FIG. 3 is a perspective view of the electrodes within the electrolyzer of the embodiment of FIG. 1.

The electrodes 22 are disposed and mounted within the electrolyzer 10 and are spaced from the bottom wall 16 and the top cover 17. The electrodes 22 are preferably interleaved anode/cathode segments and an especially preferred form is shown in FIG. 3. Such electrodes 22 are preferably of the module type as disclosed and claimed in copending application Ser. No. 618,078. The bipolar electrode 22 includes a generally plate-like metallic anode 23, a generally plate-like metallic cathode 24 separated by, and connected to, an upstanding median metallic electrode 25 having a generally U-shaped cross-section, and constituted by a pair of spaced-apart legs 26, each having a lateral wing 27 extending therefrom, by which the median electrode 25 is connected to the anode 23 and cathode 24.

The material for the anode 23 is a "suitable anodic material", namely, a material that is electrically conductive, resistant to oxidation, and substantially insoluble in the electrolyte. Platinum is the preferred material, but it would also be possible to use ruthenium, rhodium, palladium, osmium, iridium, and alloys of two or more of the above metals, or oxides of such metals.

The material for the cathode 24 is a "suitable cathodic material", namely, a material which is electrically conductive, substantially insoluble in the electrolyte under cathodic conditions, resistant to reduction, and either substantially impermeable with respect to $H_2$, or if permeable by $H_2$, dimensionally stable with respect to $H_2$. Steel is the preferred material, but it would also be possible to use copper, chromium, cobalt, nickel, lead, tin, iron or alloys of the above metals. At least the cathode is provided with a plurality of spaced-apart electrically non-conductive spacer rods 28 which project outwardly from both flat faces of the cathode.

The median electrode 25 is connected to the anode 23 at a butt edge 29 at a lateral wing 27 and to the cathode at a butt edge 30 at a lateral wing 27. The connection is preferably by means of welding. The median electrode 25 may, however, be connected to the anode 23 at a lapped joint between the anode 23 and the lateral wing 27 by means of a bolt or a screw (not shown). The median electrode 25 is provided with an upper extension 31 and a lower extension 32, the lower extension also being provided with an upwardly extending slot 33.

The median electrode 25 is preferably made of titanium or a titanium alloy. In addition, other metals for the median electrode include tantalum, zirconium and columbium and alloys of such metals. This facilitates the conducting of electric power longitudinally from the cathode plate 24 to the anode plate 23.

In addition, the median electrode 25 conducts electric power transversely through the electrolytic cell when fitted in an electrolyzer 10 in the form of a module to lower the potential differences between fitted assemblies. This tends to improve overall voltage for the electolyzer 10.

As noted above, the joint between the lateral wing 27 and the anode 23 or the cathode 24 may be welded. The anodes 23 employed are preferably of titanium, which may desirably be surface coated with platinum to improve anode performance. Similarly, the cathodes 24 employed are preferably of titanium, which may desirably be surface coated or treated to improve their cathode performance as cathode surface by the use of a coating of a "suitable cathodic material". For example, titanium sheet 1.5 mm thick having a low carbon steel cathode surface was welded and successfully used as the cathode. The coated electrodes 22 may be made using the explosion bonding technique described in Canadian Patent No. 760,427 issued June 6, 1967 to Ono et al.

Impurities in the weld of titanium tend to weaken the weld and to cause corrosion at the joint. It is therefore recommended that the butt-end to be welded be taped during the welding procedure to avoid impurities in the weld. Titanium was also successfully used as cathode material using a grit blast of aluminum oxide to increase its surface area.

The cathode plate is punched and equipped with spacer rods 28. These spacer rods 28 are designed to provide the proper cell spacing when the electrode 22 is fitted in the cell. A suitable spacer rod 28 is made of polyvinyl dichloride (PVDC). Other suitable electrically non-conductive plastics materials are those known by the Trade Marks of Kynar, Kel-F or Teflon. The spacer rods 28 may be produced by employing extruded rods which are slightly less in diameter than the holes punched in the cathode 24 with a length cut to yield the desired protrusion on the sheets. If the spacer rods 28 are made of PVDC, the cathode plate is heated at 300° C. for 2 minutes; the PVDC rods swell to form the spacer rod 28 at the same time as it longitudinally shrinks. If Kynar, Kel-F or Teflon are used, applied pressure is required. Normally the spacer rods 28 protrude from 1 to 5 mm. The number of spacer rods 28 depends on the thickness of the cathode 24, its flatness and the desired spacing. For example, for 2 mm thick standard steel cathodes with 3 mm spacing required approximately 100 mm between spacer rods. Although it is preferred to apply the spacer rods 28 to the cathodes 24, they may equally well be applied to the anodes 23.

Figure 4:
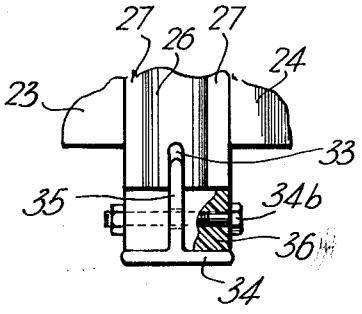
FIG. 4 is an enlarged detail of a portion of the electrode structure of FIG. 3 showing the mounting of the electrode on the support plate.

The assembly of interleaved anode 23/cathode 24 electrodes 22 provides electrolytic cells between the imaginary centre line "$n$" of a median electrode 25 and the adjacent imaginary centre line "$n + 1$" of an adjacent median electrode 25 and comprises a multiple of anodes 23, cathodes 24 and median electrodes 25. Median electrodes 25 are each fitted by hand compression into its U-shape, with the slot 33 along imaginary centre line $n$, $n + 1$, $n + 2$, etc. The slot 33 in the median electrode 25 is adapted to rest on a transverse titanium conductor plate **34*a*, which, as shown in FIGS. 3 and 4, is of inverted "T" shape, including a pair of horizontal feet 34 and an upright leg 35, into which the slot 33 fits. Mounted on the conductor plate 34*a* are plastic extrusions 36 resting on the feet 34, and adapted to support the lower end corner of the electrode 22. The plastic extrusions 36 are bolted to the conductor plate 34*a* by titanium bolts 34*b*. The upper extension provides an upper zone for electrolyte and gaseous products of electrolysis, and the lower extension provides a lower zone for electrolyte inflow. Thus, it is seen that the plurality of spaced-apart, transversely extending conductor plates 34*a* provide a bottom distributor trough 37 to permit substantially non-restricted flow of electrolyte through longitudinally extending channels 38** forming an integral part of the electrolytic cell.

The electrodes 22 are also maintained within the electrolyzer by means of a wedge 39 disposed between the vertically standing electrodes 22 and the sloping front wall 15. Wedge 39 has a dual function, namely: (i) it provides a means for holding the electrodes 22 in place during operation. By its shape it provides space at the top of the electrolyzer 10 for the installation of all the electrodes 22 with ease, i.e., when the wedge is out. (ii) It provides a means for the important function of preventing liquor flow internally.

As noted above, the electrodes 22 rest on a plate 34*a*, preferably of titanium, which elevates the electrodes 22 from the bottom of the electrolyzer 10 to provide the trough 37. The flow rate at the centre of the electrolyzer 10 represents the total flow of all cells. The ends have only one cell. Thus, the cross-sectional area of the trough and top channel may be reduced in order to minimize current leakage, by extending the plates 34*a* or by gradually lowering the height of the trough 37 longitudinally towards the ends of the electrolyzer.

The electrodes 22 are held down by a plurality of longitudinally spaced apart retaining bar 41, spaced apart by an amount similar to that of plates 34*a* and are thus disposed within the electrolyzer 10 to be spaced from the top cover 17 to provide a top channel 40. The cover 17 is bolted or clamped to the top of the electrolyzer 10, with a gasket or seal therebetween (not shown). As with the lower trough 37, the cross-sectional area of the top channel 40 may be reduced to minimize current leakage by gradually lowering the height of the top channel longitudinally towards the ends of the vessel. The cover 17 preferably is reduced gradually in height towards the ends 13, 14 to channel product more directly to the centre to minimize gas accumulation in the electrolyzer 10.

The electrolyzer vessel 10 should preferably be constructed of non-conductive material, e.g. polyester resin glass reinforced for structural strength and lined if desired with polyvinyl dichloride sheeting or other more chemical resistant liner (e.g. that known by the Trade Mark Teflon).

It has been found that contact resistance between two adjacent median electrodes 25, when fitted in the electrolyzer 10, in the form of a module, depends upon the shape of the median electrode 25 but a range of 0.1 to 0.5 ohms per square cm is attainable.

In order to operate in an essentially non-corrosive manner when operating in an electrolyte, one side of the median electrode 25 will be anodically charged and the other side will be cathodically charged. In performing as a cathode, the titanium will form a hydride and consequently some corrosion may occur should the electrolyte temperature be excessive (i.e., above 100° C. ) and equilization of electrical potential in the cell under such circumstances would be poor. No visually observed corrosion is noted, however, under normal conditions and even under most adverse conditions. In performing as an anode, the titanium would oxidize. No visually observed corrosion has been noted except if the electrical cell potential in commercial grade chloride solution exceeds 9 volts.

In electrolyzers having common channels, where the channels are separate and distinct from the cells, the electrical potential is essentially equalized in the main channels, and current leakage from or to the individual cells is found to be, for practical purposes:

$$I = \frac{E}{3R} \times \frac{n-2}{2} \times \frac{n}{2}$$

where

I = Amps
E = Electrolyzer Voltage
R = Electrolyte Resistance
$n$ = number of cells Thus, increasing number of cells per electrolyzer drastically increases current leakage. According to this invention, however, it has been found that, if the channels, i.e., channels 38, are integrated part of the cell, the voltage potential of liquor in the channels is, for practical purposes, equal to the average potential of the cell and the channel it is communicating with. The current leakage is, in this case, as per Ohms law:

$I = (e/R)$ where $e$ = voltage difference between two cells. Thus, by an aspect of this invention, the number of cells in the electrolyzer 10 is not a factor in the current leakage and relatively large channels can be employed without drastically increasing the current leakage due to the relatively low voltage driving force.

Fortuitously, by this invention, a plurality of electrode assembly modules are very readily made up with essentially no limitations as to capacity since the number of electrode assembly modules fitted longitudinally ($n$, $n + 1$, $n + 2$, etc.) determines total production output for an electrolyzer. Thus, the electrolyzer 10 may achieve high production capacities (practical range: 1000 to 10,000 tons per year production units).

It is desired to point out that the upper 31 and the lower 32 extensions of the electrode 22 respectively also lengthen the path from the anode side 23 to the cathode side 24 which, in most cases, substantially eliminates corrosion action at the top and the bottom respectively on the cathode 24 by electrical potential difference between two adjacent cells when employed in the electrolyzer 10. For current densities above 1000 ampere per square meter electrolyzing chloride and chlorate solution employing mild steel cathodes at temperatures up to 95° C., the extensions should preferably be more than 30 mm. Electrical energy is transmitted across the cell by current conduction defined by touching median electrodes and titanium conductor plates.

A pre-assembled electrode assembly, in a cell dividing plate (instead of profile) as e.g. in Canadian Patent No. 914,610, can also be employed in this electrolyzer 10 although the simplicity of the module electrode makes it a preferred assembly.

The electrolyzer 10 is, as stated before, connected to the reactor 50 by a product outflow pipe 11 and a return flow pipe 51. Product outflow pipe 11 channels electrolyte, soluble products of electrolysis and occluded gaseous products of electrolysis upwardly through top channel 40 and then horizontally centrally inwardly along top cover 17. The electrolyte and products substantially completely fill top cover 17 and product outflow pipe 11 and flow to a degasifier 52 to a liquid interface 53. Thus, as shown, the inflow 11 and outflow 51 respectively are in the centre of the electrolyzer 10. Such pipes 11, 51 could also be located elsewhere but this drastically increases flow in some parts of the electrolyzer since it is accumulated from all cells in series. By sloping the electrolyzer 10, the flow is improved compared to a horizontal unit but this makes construction and layout more difficult. Product, i.e., electrolyte and soluble products of electrolysis passed between the interelectrode space and generated cell gases, are channelled through a pipe 11 to the degasifier section 52 of the reactor 50.

The degasifier 52 comprises a rectangular box resting on the top cover 54 of the reactor 50. The bottom 55 of the degasifier communicates with the reactor 50 through registering slots 56 in the degasifier 52 and cover 54 of the reactor 50 respectively. Occluded cell gases rise to the upper portion 57 of the degasifier 52 and are drawn off by cell gas withdrawal pipe 58. The degasifier 53 should provide sufficient space for volume increase when starting up the system (usually less than 25% of the volume between the electrodes is required). Liquor will flow generally diagonally downwardly to channelling means 59 and via a central lower channel 60 to the outlet pipe 51 and thence to the same cell as discharges the product. Thus, the liquor in the reactor 50 will have one electrical potential only. The channelling means 59 is generally a quarto-cylindrical box 61 closed at the top and front, but open to provide lateral inlet openings 62 at the bottom of the reactor 50 adjacent the confluence of the back wall 63 and side walls 64 of the reactor 50. The channelling means 59 directs the liquor longitudinally inwardly to the central lower channel 60. The channelling means 59 may, alternatively, be a curtain (not shown) suspended from the top cover 54 of the reactor 50.

The electrolytic process generates heat. 60 to 80% of power input is accounted for as heat. To control electrolyte temperature, liquor in the reactor is cooled by means of a plurality of immersed U-shaped cooling coils 65 each disposed through a top nozzle 66 suspended from the cover plate 54. This provides for ease of replacement. Thus, each cooling coil 65 includes a cooling water down tube 67 and connected to a warm water up tube 68, which each pass through a top nozzle 66. Cooling water down tube 67 is connected to cooling water header tube 69, while warm water up tube is connected to warm withdrawn water header 70. Preferred coils are of titanium tubing but they may also be of other material, e.g. Teflon.

It is noted that only a single inlet is provided for fresh electrolyte (brine) i.e., via line inlet tube 71 disposed near the rear wall 63. Only one outlet is provided, namely product outlet tube 72 whose inlet is near the bottom adjacent the front wall 73 of the reactor 50. Muriatic acid is added through the down pipe 74 to control the pH level at optimum for promoting desirable reaction. In the case of chlorate, the pH should be in the range of 6 to 7.5. For control of the liquor level and/or electrolyte composition, the brine is added through the down pipe 71 and the product is discharged through a pipe riser 72 for gravity flow when the liquor is higher than the desired level.

If operating the system batchwise, the brine is for make-up only; if a continuous system, brine is added continuously. If more than one system is employed, they could be operated in series or in parallel.

The reactor 50 may be constructed of steel if it is cathodically protected with minimum current flow of 2 amps per square foot surface on all surfaces; potential more than 1 volt. A tank lined with titanium or chemically resistant plastic (e.g. Teflon) would be preferred. It should be noted that the tank may be circular. The volume of the reactor tank depends on the desired current efficiency; results indicate that current concentration should be approximately 20 amps per liter for 80% yield and 6 amps per liter for 95% yield.

A free flow providing a high rate of circulation between the electrolyzer and the reactor is essential for high efficiency. The nonrestricted channels of the cells and the large cross-sectional area of common channels provides for maximum flow from gas product uplifts. The cells are properly sealed to minimize or even avoid internal recirculation, and hence the drive is sufficient not to require a mechanical pump device; at a current density of 1 amp/square inch and electrode distance of 3/16 inch, the upward velocity is up to 30 feet per minute. Thus, the system with integrated channelling of liquor/products, avoiding internal recirculation, provides for recirculation within the system.

ii Description of FIGS. 5 - 8

Figure 6:
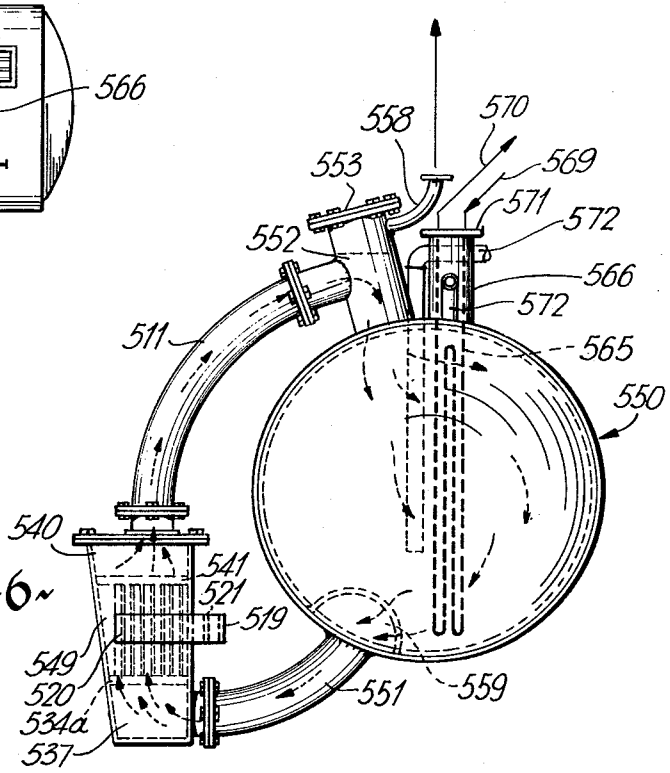
FIG. 6 is an end view, partially in phantom, of the embodiment of FIG. 5.
Figure 5:
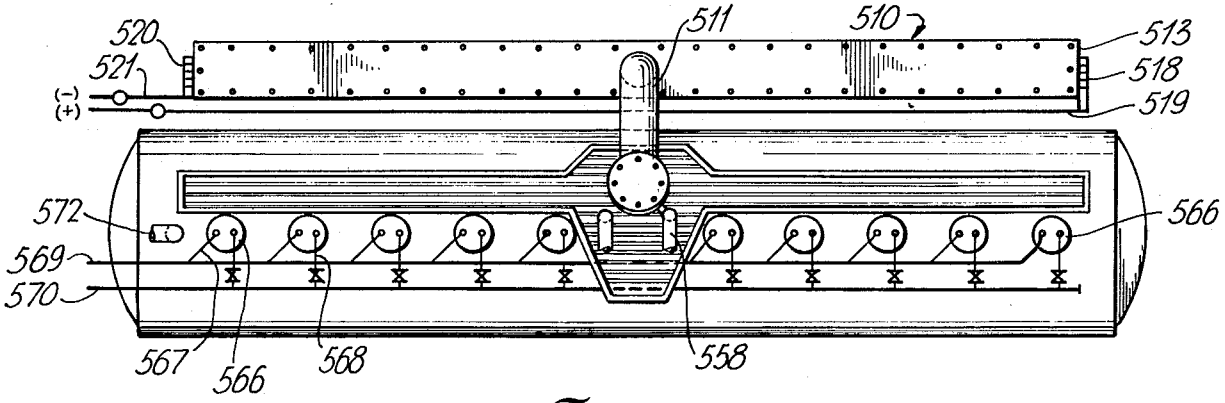
FIG. 5 is a top plan view of an electrolytic system according to this invention.

The embodiment shown in FIGS. 5 - 8 includes a generally rectangular parallelepiped electrolyzer 510 and a generally cylindrical reactor 550. As seen in FIG. 6, the reactor 550 is at a higher vertical level than that of the electrolyzer 510. While the rectangular reactor 50 of the first embodiment is more economical as far as space is concerned, the cylindrical reactor 550 is lower in cost per unit volume.

The electrolyzer 510 is connected to reactor 550 by means of outflow riser pipe 511 and by return downflow pipe 551. The pipe riser 511 assists in assuring a maximum flow rate of electrolyte to provide maximum efficiency. The desired flow is assured by gas-lift from the cells which are designed (as will be evident hereafter) to prevent overflow from short circuiting to the bottom of the cell, i.e., the overflow returns via the reactor 551. Using the pipe riser 551 additional lift may be obtained by the fact that the electrolyte contains dispersed gas, and thus, has a lower, i.e. 1/2, the density compared to the degasified liquor in reactor. Thus, a "head" is built up in the reactor resulting in hydraulic flow into the electrolyzer 510. The amount of such head depends upon the current density and the circulating rate.

The higher elevation for the pipe riser 511 increase the flow rate but however this also increases pressure on the cell. For the limited benefit of the extra flow rate it is not desirable to employ too high an elevation difference. Normally the reactor 550 is not more than 3 meters above the electrolyzer 510.

The electrolyzer 51 is generally a rectangular parallelepiped but includes in addition to a back wall 512 and end walls 513, 514, a downwardly sloping front wall 515. It is also provided with a flat bottom wall 516 and a transversely flat but centrally upwardly sloping top cover 517. Anode end sheeting 518 is secured to end wall 513 and is connected to an anode source (not shown) by means of a longitudinally extending anode bus bar 519. Similarly, cathode end sheeting 520 is secured to end wall 514 and is connected to a cathode source (not shown) by a longitudinally extending cathode bar 521.

The electrodes 522 are disposed and mounted within the electrolzyer 510 and are spaced from the bottom wall 516 and the top cover 517. The electrodes within electrolyzer 510 are the same as that shown in FIGS. 3 and 4.

Figures 7, 8:
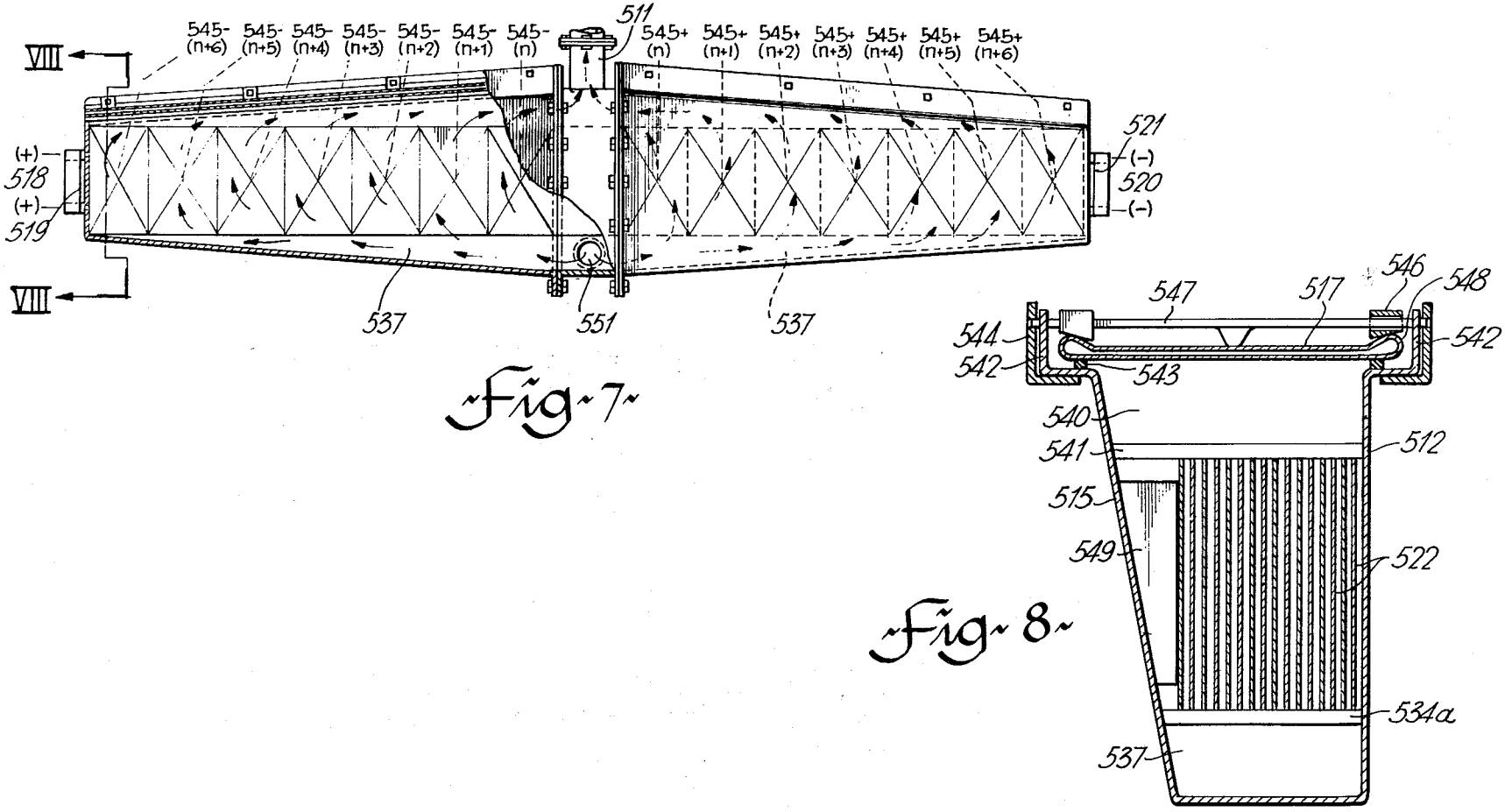
FIG. 7 is a side elevational view, partially broken away, of the electrolyzer of the embodiment of FIG. 5.
FIG. 8 is a section along the line VII—VII of FIG. 7.

As seen in FIG. 7, the electrolyzer includes a central section 545 of electrolytic cells composed of electrodes 22 (as shown in FIG. 3), and a plurality of sections $545+n$, $545+(n+1)$, $545+(n+2)$ etc. of electrolytic cells on one side thereof, and a similar pluraliy of sections $545-n$, $545-(n\ 1)$, $545-(n+2)$ etc. of electrolytic cells on the other side thereof. While only 15 sections are shown, (i.e., the central section and seven sections on each side), there may be any number. It is likely that less than 200 will be used to be within practical bounds.

The electrodes rest upon a plurality of longitudinally spaced apart plates 534*a* (similar to those shown in FIGS. 3 and 4) to provide a lower trough 537, and is held down by a similar plurality of similarly longitudinally spaced apart retaining bars 541 to provide a top channel 540. It will be observed that top channels 540 and bottom trough 537 slope, with increasing cross-sectional area to the central section 545, where pipe riser outlet 511 and return downpipe inlet 551 are located. The sloped channels 540 and 537 at the top and bottom respectively are mainly to minimize current leakage (I = (E/R) where R is increased with decreasing cross-section of channel i.e., further away from central section). The cross-sectional areas of the channels 540 and 537 are designed for the flow requirements. Thus, the chanels at the center cell have an accummulated total flow when the adjacent cells each have only one half flow and the end channels have the flow of only one cell. Thus, the cell closest to the end require a small channel cross-sectional area. The slope of the top channel 540 also provides means of minimizing the accumulation of gases, i.e., it provides a substantially liquor filled electrolyzer 510.

FIG. 8 shows more clearly how the top cover 517 is mounted on the top of the electrolyzer. It is seen that the upper edge of the front wall 515 and the rear wall 512 of the electrolyzer 510 are provided with a tray 542 to minimize the spillage of liquor in case of a leak. The cover 517 is spaced from the tray 542 by a gasket 543 and is clamped in place by an L-shaped clamp 544 engaging the tray 542 and a wedge 546 slidably mounted on a cross bar 547. The wedge 546 frictionally locks against a rim 548 of the cover 517.

It would, of course, be possible to use a simple bolted joint, but, while such joint is more secure, it is much slower to install.

A novel procedure and structure has been adapted to mount the interleaved electrodes 522 between the front wall 515 and the back wall 512. In order to minimize costs, the electrodes vary in thickness and the tolerance limits are not set too tightly. Even providing an average tolerance of 5/1000 inch + for the width for the spacing of assembled electrodes, the width dimensions of a cell employing perhaps 100 interleaved electrode plates would be ½ inch more than an adjacent cell. This creates difficult problems in installation. The variation in total cell width is compensated by providing a wedge 549 which gives plenty of space for the installation of the electrode plates. Adjustment for width variation of the assembled interleaved electrodes is provided by elevation of the wedge 549. It is seen that one wedge 549 is provided for each cell. The wedge 549 may be full length of the cell or may extend partially only using a top plate (to provide a liquor flow seal) which extends the full length of a cell.

It is seen that this is a significant simplification in the manufacture, and assembly and installation of the electrodes. If the front wall 515 was vertical the width of the electrolyzer 510 must be wider than the maximum width of assembled cells. The spacer plates would have to be individually installed which will vary from one cell to another. This is slow and requires close tolerance fitting and is more difficult than employing the wedge 549.

The reactor 550 is generally cylindrical in shape and is provided with a central degasifier column 552, mounted at the top of the reactor 550 at a slight angel, to provide a gas separation zone 553 therein, from which leads a cell gas withdrawal pipe 558. Adjacent the degasifier column is a bombined brine and (if desired) muriatic acid downcomer inlet tube 71 leading downwardly into the bottom zone of the reactor 550, and a product overflow pipe 558 leading directly from the top zone of the reactor 550. A semi-cylindrical trough 559 extending the full longitudinal length of the reactor 550 is closed at its curved walls, but is open at its ends 562 adjacent the circular end walls 564 of the reactor 550. This channels the liquor flow to the ends of the reactor 550 for full utilization and retention time. The channelling trough 559 leads to a central outflow channel 560 leading to downflow outlet pioe 551.

In order to cool the reactor liquor a plurality of closed loop downwardly extending cooling coils 565 are provided. Each cooling coil is mounted within a cooling turret 556 covered by a cover 771 pierced by cooling water inlet pipe 567 fed by header line 569, and warm water outlet pipes 568, leading to header line 570.

iii. Description of FIG. 9

Figure 9:
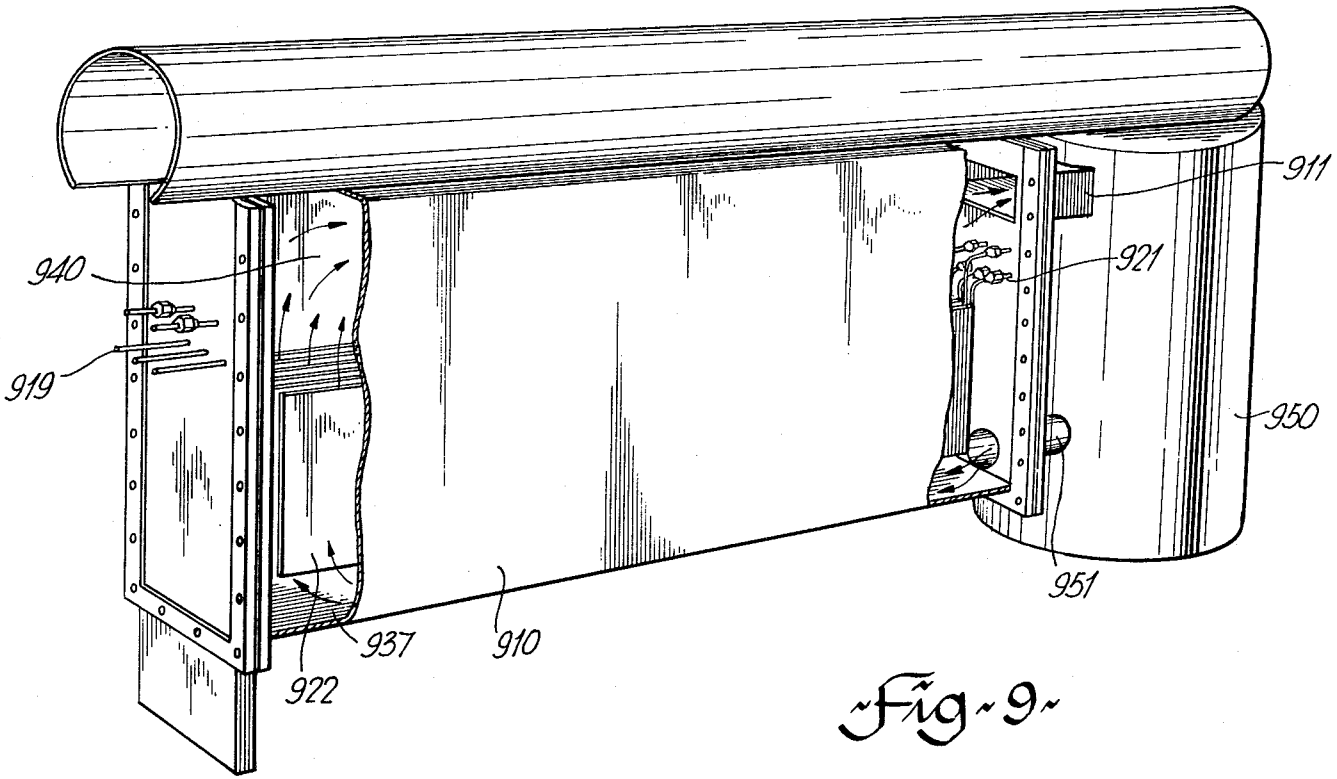
FIG. 9 is a perspective view, partially broken away, of an electrolytic system according to this invention.

The variant of FIG. 9 shows an electrolyzer 910 and a reactor 950 substantially the same as the electrolyzer 10 and reactor 50 of FIGS. 1 - 4. However, electrolyzer 910 is rectangular while reactor 950 is an upright cylindrical disposed at one longitudinal end of the electrolyzer 910. Moreover, top channel 940 leads directly longitudinally to a rectangular header 9401 leading to the same general type of degasifier as described for reactor of the embodiment of FIGS. 1 - 4. The electrolyte return flow pipe 951 leads directly, longitudinally, to the lower distributor trough 937. All other elements of the embodiment of FIGS. 1 - 4, i.e., the anode and cathode sheetings and bus bars, the cooling means, the product withdrawal means, the fresh electrolyte inlet and pH adjustment inlet are the same as in the embodiment of FIGS. 1 - 4. However, the gas outlet leads to a gas conduit 9571 for safe removal thereof.

iv. Description of FIGS. 10 and 11

Figure 10:
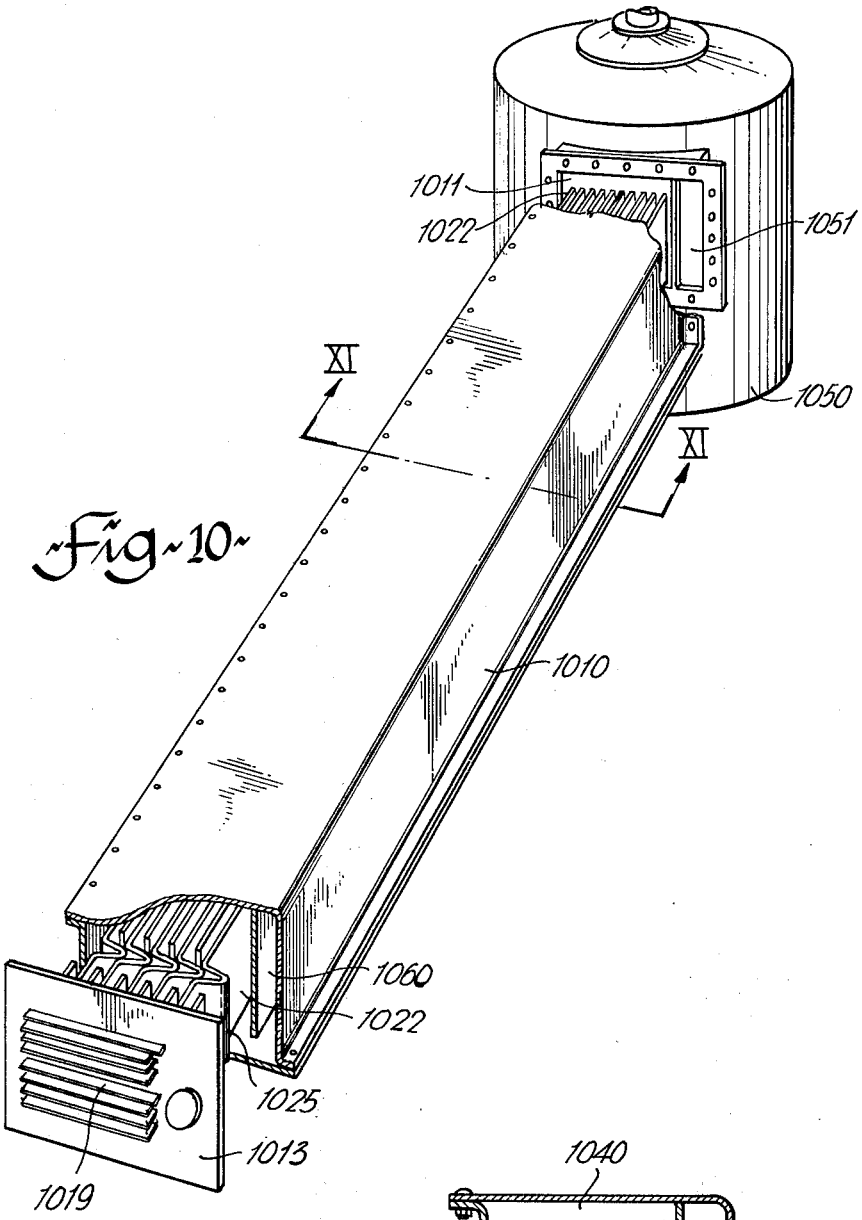
FIG. 10 is a perspective view, partially broken away, of an electrolytic system according to this invention.
Figure 11:
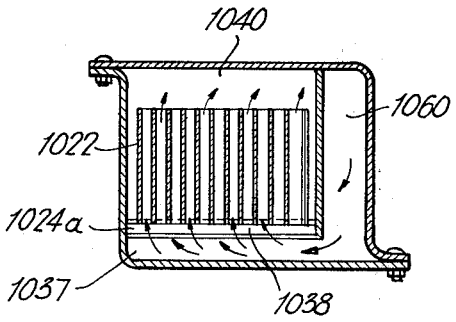
FIG. 11 is a section, along the line XI—XI of the embodiment of FIG. 10.

Another variation of the electrolyzer 10/reactor 50 system of FIGS. 1 - 4 is shown in FIGS. 10 and 11. Since the essential components of the system are the same, only the differences will be described.

The electrolyzer 1010 is generally of rectangular parallelepiped form provided at its ends 1013, 1014 with anode end sheeting 1018 and anode bus bars 1019, and cathode end plates and cathode bus bars (not seen). The electrolyzer is provided with a lower distributor trough 1037 and upper product header 1040. Upper product header 540 leads to a degasifier (not seen) associated with reactor 1050 of structure analogous to that described with reference to FIGS. 1 - 4. The structure of the reactor 1050 is the same as the upright cylindrical reactor 950 of FIG. 9. This cooling means, product removal, gas withdrawal, fresh electrolyte inlet, and pH control are all the same as described with reference to FIGS. 1 - 4. However, returned electrolyte is by means of lateral horizontal channel 1060 which provides unrestricted liquor access to bottom trough 1037.

OPERATION OF PREFERRED EMBODIMENTS i. Operation of the Embodiment of FIGS. 1 - 4

The liquor and electrolyte flow may be described as follows: Fresh electrolyte is fed bia line 71, with or without a pH adjusting amount of muriatic acid is fed in via line 74 and it travels longitudinally along the bottom of the reactor 50 to the inlet ends 62 of the channelling trough 59, which which leads to the central outflow channel 60 and then down the down flow outlet tube 51 to the bottom trough 37 of the electrolyzer 10. The liquor flows longitudinally along the bottom trough 37 and then upwardly through open channels 38 to the interelectrode spaces between interleaved anode/cathode electrodes 22. The liquor passes upwardly through the interelectrode spaces to the top channel 40. The liquor including the soluble ion products of electrolysis and occuluded gaseous products of electrolysis then travels longitudinally from the ends towards the central zone 45 and thence to the pipe riser 11 to the degasifier tower 52. There the gas is separated in gaseous space 53 and is drawn off via pipe 58. The liquor then travels downwardly to the inlet ends 62 of the channelling trough 60. A small amount equal to the amount of fresh electrolyte added through line 71, and munatic acid added through line 74, of liquor is withdrawn through product outlet pipe 72.

ii. Operation of the Embodiment of FIGS. 5 - 8

The liquor and electrolyte flow may be described as follows: Fresh electrolyte with or without a pH adjusting amount of muriatic acid is fed in via line 571 and it travels longitudinally along the bottom of the reactor 550 to the inlet ends 562 of the channelling trough 559, which leads to the central outflow channel 560 and then down the down flow outlet tube 551 to the bottom trough 537 of the electrolyzer 510. The liquor flows longitudinally along the bottom trough 537 and then upwardly through open channels 538 to the interelectrode spaces between interleaved anode/cathode electrodes 522. The liquor passes upwardly through the interelectrode spaces to the top channel 540. The liquor including the soluble ion products of electrolysis and occuluded gaseous products of electrolysis then travels longitudinally from the ends towards the central zone 545 and thence to the pipe riser 511 to the degasifier tower 552. There the gas is separated in gaseous space 553 and is drawn off via pipe 558. The liquor then travels downwardly to the inlet ends 562 of the channelling trough 560. A small amount, equal to the amount of fresh electrolyte added through line 571, of liquor is withdrawn through product overflow pipe 572.

iii. Operation of the Embodiment of FIG. 9

In operation, the variant of FIG. 9 is similar to that of FIGS. 1 - 4, but the flow pattern is as follows: Fresh electrolyte, is fed in via electrolyte inlet line (not seen) with or without a pH adjusting amount of muriatic acid via acid inlet line, (not seen) and it travels along the bottom of the reactor 960 to the inlet ends of the channelling trough, which leads to the central outflow channel and then through liquor outlet tube 951 to the bottom trough 937 of the electrolyzer 910. The liquor flows longitudinally along the bottom trough 537 and also, as it flows, upwardly through the open channels to the interelectrode spaces between interleaved anode/cathode electrodes 922. The liquor passes upwardly through the interelectrode spaces to the top channel 940. The liquor, including the soluble ion products og electrolysis and occuluded gaseous products of electrolysis then travels longitudinally towards the outlet end zone and thence to the outlet pipe 911 to the degasifier tower. There, the gas is separated in the gaseous space and is drawn off via outlet pipe to gas conduit 9571. The liquor then travels downwardly to the inlet ends of the channelling trough. A small amount, equal to the amount of fresh electrolyte and, if necessary acid, added, of liquor is withdrawn through the product withdrawal pipe.

iv. Operation of the Embodiment of FIGS. 10 and 11

In operation, the variant of FIGS. 10 and 11 is similar to the embodiment of FIGS. 1 - 4. The flow pattern is as follows: Fresh electrolyte is added through electrolyte inlet, with or without a pH adjusting amount of muriatic acid, and it travels along the bottom of the reactor 1060 to the inlet ends of the channelling trough, which leads to an outflow channel and then through the outlet channel 1051 to the lateral horizontal channel 1060 to the bottom trough 1037 of the electrolyzer 1010. the liquor, as it flows back longitudinally in channel 1060, also flows transversly into the bottom trough 1037 and then upwardly through open channels 1038 to the interelectrode spaces between interleaved anode/cathode electrodes 1022. The liquor passes upwardly through the interelectrode spaces to the top channel 1040. The liquor including the soluble ion products of electrolysis and occuluded gaseous products of electrolysis then travels longitudinally forwardly towards the outlet channel 1011 to the degasifier tower. There, the gas is separated in the gaseous space and is drawn off via the gas outlet pipe. The liquor then travels downwardly to the inlet ends of the channelling trough. A small amount, equal to the amount of fresh electrolyte and, if necessary, acid added through, of liquor is withdrawn through product overflow pipe.

SUMMARY

Thus, by this invention a novel electrolytic system is provided for chlorate manufacture. The novel combination of the electrolyzer and reactor provides improved economies of manufacture and assembly, and improved efficiencies of operation.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. An improved closed loop system for effecting an electrolysis reaction and for subsequently removing reacted products of electrolysis said system comprising an electrolyzer, a reactor, a major liquor outflow means from said electrolyzer to said reactor and a major liquor inflow means from said reactor to said electrolyzer:

1. said electrolyzer including a plurality of electrically interconnected electrolytic cells, said electrically interconnected electrolytic cells including a selected cell and other cells, said other cells also being provided with liquor conduit means leading between said cells to said selected electrolytic cell, and liquor conduit means leading from said selected electrolytic cell to said other cells, said selected cell being provided with liquor outlet means connected directly to said major liquor outflow means, and liquor inlet means connected directly from said major liquor inflow means for removal of liquor and entrained and/or entrapped gaseous products of electrolysis from said electrolyzer and return of degasified liquor to said electrolyzer;

and 2. said reactor means including degasifier means disposed atop said reactor means, and connected directly to said major liquor outflow means, said degasifier means including an upper gas outlet means for withdrawal of the separated gases, and a lower outlet slot directly connected to an upper zone of said reactor means, for the introduction of the substantially gasfree liquor into said reactor means, said reactor means including a lower liquor channelling means, connected to said major liquor inflow means to recirculate liquor back to said electrolyzer, conduit means for the introduction of fresh liquor, to said reactor conduit means for the introduction of a pH adjusting liquid, to said reactor and indirect cooling means coupled to said reactor.

2. A combined electrolytic apparatus comprising an electrolyzer, a reactor, a major liquor outflow means from said electrolyzer to said reactor and a major liquor inflow means from said reactor to said electrolyzer:

1. said electrolyzer comprising

A. major liquor inflow means for the introduction of electrolyte thereto and major liquor outflow means for the withdrawal of products of electrolysis therefrom;

B. a plurality of electrically interconnected electrolytic cells, each of said electrolylic cells being provided with liquor inlet means and liquor outlet means and also being provided with bipolar metal electrodes disposed in the path of the electrolyte flow between said inlet means and said outlet means, one end wall providing an anodic end sheeting, the other end wall providing a cathodic end sheeting, with an anode bus bar connected to said anodic end sheeting, and a cathodic bus bar connected to said cathodic end sheeting, said electrically interconnected electrolytic cells including a selected cell and other cells, said other cells also being provided with liquor conduit means leading between said cells to said selected electrolytic cell, and liquor conduit means leading from said selected electrolytic cell to said other cells, said selected cell the inlet means to, and the outlet means from said electrolyzer are from the same selected electrolytic cell;

C. a downwardly sloping front wall;

and D. a wedge disposed between said electrodes and said front wall, thereby to hold the electrodes in place, and to minimize internal liquor overflow between adjacent cells;

and 2. said reactor including

E. degasifier means disposed atop said reactor means, and connected directly to said major liquor outflow means said degasifier means including an upper gas outlet means for the withdrawal of the separated gases, and a lower outlet slot directly connected to an upper zone of said reactor means, for the introduction of the substantially gas-free liquor into said reactor means, F. a lower liquor channelling means, connected to said major means to recirculate liquor from said reactor back to said electrolyzer, G. conduit means for the introduction of fresh liquor to said reactor;

H. conduit means for the introduction of a pH adjustment liquid adjustment liquid to said reactor;

and I. indirect cooling means coupled to said reactor.

3. An electrolysis system comprising an electrolyzer, a major liquor outflow means from said electrolyzer to said reactor and a major liquor inflow means from said reactor to said electrolyzer;

A. major liquor inflow means for the introduction of electrolyte thereto and major liquor outflow outlet means for the withdrawal of products of electrolysis therefrom;

B. a plurality of electrically interconnected electrolytic cells, each of said electrolylic cells being provided with liquor inlet means and liquor outlet means and also being provided with bipolar metal electrodes disposed in the path of the elecrolyte flow between said inlet means and said outlet means, one end wall providing an anodic end sheeting, the other end wall providing a cathodic end sheeting, with an anode bus bar connected to said anodic end sheeting, and a cathodic bus bar connected to said cathodic end sheeting, said electrically interconnected electrolytic cells including a selected cell and other cells, said other cells also being provided with liquor conduit means leading between said cells to said selected electrolytic cell, and liquor conduit means leading from said selected electrolytic cell to said other cells, said selected cell the inlet means to, and the outlet means from, said electrolyzer are from the same selected electrolytic cell;

C. a downwardly sloping front wall;

D. a wedge disposed between said electrodes and said front wall, thereby to hold the electrodes in place, and to minimize internal liquor overflow between adjacent cells;

E. a lower liquor distributing trough connected to the liquor inlet means of each electrolytic cell and disposed below said bipolar electrodes;

F. a top liquor distributing channel disposed above said bipolar electrodes, and connected directly to the liquor outlet means of each electrolytic cell;

and G. internal electrolyte circulation means for each electrolytic cell provided by the arrangement of said bipolar electrodes;

2. said reactor for effecting a further degasification and a reaction on the liquid products of electrolysis including:

H. degasifier means disposed atop said reactor means, and connected directly to said major liquor outflow means said degasifier means including an upper gas outlet means for the withdrawal of the separated gases, and a lower outlet slot directly connected to an upper zone of said reactor means, for the introduction of the substantially gas-free liquor into said reactor means;

I. a lower liquor channelling means, connected to said major inflow means to recirculate liquor from said reactor back to said electrolyzer, J. means for recycling a determined proportion of the liquid reaction products to said electrolyzer;

K. means for regulating the temperature of the products recycled to said electrolytic cell, said means including a plurality of water heat exchanger coils projecting downwardly centrally within the reactor;

and L. means for withdrawing a determined proportion of the effluent from the system, said means including a depending effluent pipe whose inlet is disposed near the bottom of said reactor and whose outlet is adapted to withdraw liquor through a top nozzle.

4. The system of claim 1 wherein said electrolyzer comprises a longitudinally extending vessel; wherein said reactor comprises a longitudinally extending vessel; and wherein said electrolyzer and said reactor are disposed in side-by-side relation to one another with said major liquor inflow means extending transversely from said electrolyzer, and with said major liquor means extending transversely from said reactor.

5. The system of claim 4 wherein the electrolyzer cover comprises a semi-cylindrical member whose radius is non-uniform from one end to the other.

6. The system of claim 5 wherein the radius is greater at the centre than at each of the ends of said cover.

7. The system of claim 5 wherein the radius is greater at one end than at the other end of said cover.

8. The system of claim 7 wherein the outflow pipe leads directly from said cover, from a point adjacent the greater radius end thereof.

9. The system of claim 6 wherein the outflow pipe leads directly from said cover, from said point between the ends thereof, of the greatest radius.

10. The system of claim 4 wherein the anode bus bar and the cathode bus bar are disposed between the electrolyzer and the reactor.

11. The system of claim 4 wherein said vessel is taller than the height of said electrodes, thereby to provide a trough at the bottom and a channel at the top, said trough being defined by the bottom of said electrolyzer and by a titanium plate upon which said electrodes rest, said bottom trough providing a distributor for the recirculation of return flow liquor fed from said major liquor inflow means and wherein said channel at the top provides a header for the withdrawal of products of electrolysis to said major liquor outflow means.

12. The system of claim 11 wherein said cross-sectional area of said trough is made larger towards the direction of said selected electrolytic cell which is directly connected to said major liquor outflow means.

13. The system of claim 11 wherein said cross-sectional area of said top channel is made larger towards the direction of said selected electrolytic cell which is directly connected to said major liquor outflow means.

14. The system of claim 11 wherein said cross-sectional area of said trough is made larger towards the direction of said selected electrolytic cell which is connected to said liquor outflow means and further wherein said cross-sectional area of said top channel is made larger towards the direction of said selected electrolytic cell which is directly connected to outflow means.

15. The system of claim 1 wherein said electrolyzer comprises a longitudinally extending rectangular parallelepiped vessel, wherein said reactor comprises an upright cylindrical vessel, wherein said reactor is disposed at the downstream end of the electrolyzer, wherein said major liquor outflow means extends longitudinally from said electrolyzer to a side wall of said reactor, and wherein said major liquor inflow means extends from said side wall of said reactor longitudinally to said electrolyzer.

16. The system of claim 15 wherein said electrolyzer vessel is taller than the height, of said electrodes, thereby to provide a trough at the bottom and a channel at the top, said trough being defined by the bottom of said electrolyzer and by a titanium plate upon which said electrodes rest, said bottom trough providing a distributor for the recirculation of return flow liquor fed from said major liquor inflow means wherein said channel at the top provides a header for the withdrawal of products of electrolysis to said major liquor outflow means and further wherein said bottom trough is fed from a liquor return header extending longitudinally along one side wall of said electrolyzer which is connected to a vertically extending outlet slot in the side wall of said reactor.

17. The system of claim 16 wherein said electrolyzer is provided with a sloping cover, wherein said cross-sectional area of said top channel is made larger towards the direction of said selected electrolytic cell which is directly connected to said major outflow means.

18. The system of claim 16 wherein said cross-sectional area of said trough is made larger towards the direction of said selected electrolytic cell which is directly connected to said major liquor outflow means.

19. The system of claim 17 and still further wherein said cross-sectional area of said trough is made larger towards the direction of said selected electrolytic cell which is directly connected to said major liquor outflow means.

20. The system of claim 1 wherein said electrolyzer comprises a longitudinally extending rectangular parallelepiped vessel, wherein said reactor comprises an upright right cylindrical vessel, wherein said reactor is disposed at the downstream end of said electrolyzer, wherein said major liquor outflow means extends longitudinally from said electrolyzer and wherein said major liquor outflow and inflow means extends from said side wall of said reactor longitudinally to said electrolyzer and wherein said electrolyzer cover comprises a semi-cylindrical member whose radius is greater at one end than at the other end of said cover.

21. The system of claim 20 wherein said electrolyzer vessel is taller than the electrode height of said electrodes, thereby to provide a trough at the bottom and a channel at the top, said trough being defined by the bottom of said electrolyzer and by a titanium plate upon which said electrodes rest, said bottom trough providing a distributor for the recirculation of return flow liquor fed from said major liquor inflow means, and wherein said channel at the top provides a header for the withdrawal of products of electrolysis to said major liquor outflow means.

22. The system of claim 21 wherein said cross-sectional area of said trough is made larger towards the direction of said selected electrolytic cell which is directly connected to said major liquor outflow means.

23. The system of claim 21 wherein said cross-sectional area of said top channel is made larger towards the direction of said selected electrolytic cell which is directly connected to said major liquor outflow means.

24. The system of claim 22 wherein said cross-sectional area of said top channel is made larger towards the direction of said selected electrolytic cell which is directly connected to said major liquor outflow means.

25. The combined electrolytic apparatus of claim 2 wherein, in said electrolyzer said electrodes comprise a plurality of banks of electrodes, each bank comprising a plurality of interleaved anodes and cathodes and median electrodes, and wherein a wedge is provided for each said bank of electrodes.

26. The combined electrolytic apparatus of claim 25 wherein said wedge extends for substantially the entire height of said electrode bank.

27. The combined electrolytic apparatus of claim 25 wherein said wedge cooperated only with the top portion of said electrodes and wherein said wedge is associated with a top plate providing a liquor seal.

28. The combined electrolytic apparatus of claim 1 wherein said major liquor outflow means includes an outflow riser pipe leading to said degasifier zone of said reactor.

29. An enclosed electrolyzer comprising:

A. major liquor inflow means for the introduction of electrolyte thereto and major liquor outflow means for the withdrawal of products of electrolysis therefrom;

B. a plurality of electrically interconnected electrolytic cells, each of said electrolylic cells being provided with liquor inlet means and liquor outlet means and also being provided with bipolar metal electrodes disposed in the path of the electrolyte flow between said inlet means and said outlet means, one end wall providing an anodic end sheeting, the other end wall providing a cathodic end sheeting, with an anode bus bar connected to said anodic end sheeting, and a cathodic bus bar connected to said cathodic end sheeting, said electrically interconnected electrolytic cells including a selected cell and other cells, said other cells also being provided with liquor conduit means leading between said cells to said selected electrolytic cell, and liquor conduit means leading from said selected electrolytic cell to said other cells, said selected cell the inlet means to, and the outlet means from said electrolyzer are from the same selected electrolytic cell;

C. a downwardly sloping front wall;

and D. a wedge disposed between said electrodes and said front wall, thereby to hold the electrodes in place, and to minimize internal liquor overflow between adjacent cells.

30. An enclosed electrolyzer comprising:

A. major liquor inflow means for the introduction of electrolyte thereto and major liquor outflow outlet means for the withdrawal of products of electrolysis therefrom; p1 B. a plurality of electrically interconnected electrolytic cells, each of said electrolylic cells being provided with liquor inlet means and liquor outlet means and also being provided with bipolar metal electrodes disposed in the path of the elecrolyte flow between said inlet means and said outlet means, one end wall providing an anodic end sheeting, the other end wall providing a cathodic end sheeting, with an anode bus bar connected to said anodic end sheeting, and a cathodic bus bar connected to said cathodic end sheeting, said electrically interconnected electrolytic cells including a selected cell and other cells, said other cells also being provided with liquor conduit means leading between said cells to said selected electrolytic cell, and liquor conduit means leading from said selected electrolytic cell to said other cells, said selected cell the inlet means to, and the outlet means from, said electrolyzer are from the same selected electrolytic cell;

C. a downwardly sloping front wall;

D. a wedge disposed between said electrodes and said front wall, thereby to hold the electrodes in place, and to minimize internal liquor overflow between adjacent cells;

E. a lower liquor distributing trough connected to the liquor inlet means of each electrolytic cell and disposed below said bipolar electrodes;

F. a top liquor distributing channel disposed above said bipolar electrodes, and connected directly to the liquor outlet means of each electrolytic cell;

and G. internal electrolyte circulation means for each electrolytic cell provided by the arrangement of said bipolar electrodes.

31. A reactor means for use with an electrolytic system, having a major liquor outflow means from an electrolyzer to said reactor and a major liquor inflow means from said reactor to said electrolyzer:

said reactor including degasifier means disposed atop said reactor means, and connected directly to said major liquor outflow means said degasifier means including an upper gas outlet means for the withdrawal of the separated gases, and a lower outlet slot directly connected to an upper zone of said reactor means, for the introduction of the substantially gas-free liquor into said reactor means; a lower liquor channelling means, connected to said major means to recirculate liquor from said reactor back to said electrolyzer; conduit means for the introduction of fresh liquor to said reactor; conduit means for the introduction of a Ph adjustment liquid adjustment liquod to said reactor; and I. indirect cooling means coupled to said reactor.

32. A reactor for use with an electrolysis system, having a major liquor outflow means from said electrolyzer to said reactor and a major liquor inflow means from said reactor to said electrolyzer for effecting a further degasification and a reaction on the liquid products of electrolysis, said reactor including:

E. degasifier means disposed atop said reactor means, and connected directly to said major liquor outflow means said degasifier means including an upper gas outlet means for the withdrawal of the separated gases, and a lower outlet slot directly connected to an upper zone of said reactor means, for the introduction of the substantially gas-free liquor into said reactor means;

F. a lower liquor channelling means, connected to said major means to recirculate liquor from said reactor back to said electrolyzer;

G. conduit means for the introduction of fresh liquor to said reactor;

H. conduit means for the introduction of a pH adjustment liquid

J. means for recycling a determined proportion of the liquid reaction products to said electrolyzer;

K. means for regulating the temperature of the products recycled to said electrolytic cell, said means including a plurality of water heat exchanger coils projecting downwardly centrally within the reactor;

and L. means for withdrawing a determined proportion of the effluent from the system, said means including a depending effluent pipe whose inlet is disposed near the bottom of said reactor and whose outlet is adapted to withdraw liquor through a top nozzle.

* * * * *